US010683593B2

(12) United States Patent
Gupta

(10) Patent No.: US 10,683,593 B2
(45) Date of Patent: Jun. 16, 2020

(54) PILE FABRIC AND METHODS FOR MANUFACTURE OF THE SAME

(71) Applicant: Trident Limited, Barnala (IN)

(72) Inventor: Abhishek Gupta, Barnala (IN)

(73) Assignee: Trident Limited (IN)

( * ) Notice: Subject to any disclaimer, the term of this patent is extended or adjusted under 35 U.S.C. 154(b) by 0 days.

(21) Appl. No.: 15/281,271

(22) Filed: Sep. 30, 2016

(65) Prior Publication Data

US 2017/0088986 A1 Mar. 30, 2017

(30) Foreign Application Priority Data

Sep. 30, 2015 (IN) ..... 3137/DEL/2015

(51) Int. Cl.

*D03D 27/08* (2006.01)
*D03D 15/00* (2006.01)
*D03D 27/06* (2006.01)

(52) U.S. Cl.

CPC ..... *D03D 27/08* (2013.01); *D03D 15/0027* (2013.01); *D03D 15/0033* (2013.01); *D03D 27/06* (2013.01); *D10B 2401/024* (2013.01); *Y10T 428/23957* (2015.04); *Y10T 428/23993* (2015.04)

(58) Field of Classification Search

CPC ..... D03D 27/00; D03D 27/06; D03D 27/08; Y10T 428/23957; Y10T 428/23993

See application file for complete search history.

(56) References Cited

U.S. PATENT DOCUMENTS 3,154,837 A * 11/1964 De Mestral ..... A44B 18/0034 139/46
3,169,557 A * 2/1965 Holland ..... D03D 1/00 139/383 R
3,721,272 A * 3/1973 Hager ..... D03D 27/08 139/396
4,259,994 A * 4/1981 Hobson ..... D03D 25/00 139/1 R
7,914,592 B2 * 3/2011 Sun ..... D03D 1/0017 19/150
RE45,243 E * 11/2014 Wang ..... D02G 3/28 139/116.1
9,353,465 B2 * 5/2016 Teshima ..... D02G 3/406
9,534,323 B1 * 1/2017 Dubey ..... D03D 27/08
2004/0131821 A1 * 7/2004 Mandawewala ..... D02G 3/406 428/97

(Continued)

FOREIGN PATENT DOCUMENTS

CN 102277675 A * 12/2011
JP 08013283 A * 1/1996

*Primary Examiner* — Cheryl Juska

(74) *Attorney, Agent, or Firm* — Lerner, David, Littenberg, Krumholz & Mentlik, LLP

(57) ABSTRACT

The invention provides a novel pile fabric and a method for manufacturing the novel pile fabric. The pile fabric comprises: (i) a woven ground fabric comprising a plurality of warp yarns and a plurality of weft yarns intersecting the plurality of warp yarns, (ii) one or more pile yarns woven to form a plurality of pile loops extending from the ground fabric, wherein (a) at least one pile yarn from among the one or more pile yarns is a multi-ply pile yarn comprising a first pile component yarn plied with a second pile component yarn, and (b) a turns-per-loop ratio of the multi-ply pile yarn is less than 1.9 turns-per-loop.

8 Claims, 4 Drawing Sheets

(56) References Cited

U.S. PATENT DOCUMENTS

| | | | | |
|---|---|---|---|---|
| 2007/0087162 | A1* | 4/2007 | Mandawewala | D02G 3/36 428/97 |
| 2009/0078330 | A1* | 3/2009 | Wang | D02G 3/28 139/25 |
| 2009/0235498 | A1* | 9/2009 | Sun | D03D 1/0017 28/179 |
| 2012/0076971 | A1* | 3/2012 | Debnath | D02G 3/04 428/85 |
| 2013/0037163 | A1* | 2/2013 | Teshima | D02G 3/406 139/391 |
| 2014/0248461 | A1* | 9/2014 | Mandawewala | D02G 3/36 428/76 |
| 2015/0068000 | A1* | 3/2015 | Asano | D04B 1/04 28/168 |
| 2015/0104990 | A1* | 4/2015 | Mandawewala | D02G 3/36 442/190 |
| 2015/0110992 | A1* | 4/2015 | Mandawewala | D02G 3/36 428/85 |
| 2016/0037977 | A1* | 2/2016 | Hozumi | D03D 1/0017 139/391 |
| 2016/0208420 | A1* | 7/2016 | Hozumi | D03D 15/0027 |
| 2017/0275791 | A1* | 9/2017 | Mandawewala | D02G 3/36 |
| 2017/0342609 | A1* | 11/2017 | Mandawewala | D02G 3/38 |
| 2018/0080151 | A1* | 3/2018 | Goenka | D03D 15/0077 |

* cited by examiner

PILE FABRIC AND METHODS FOR MANUFACTURE OF THE SAME

FIELD OF THE INVENTION

The present invention relates to pile fabrics and methods for manufacture of pile fabrics. In particular, the present invention relates to a pile fabric having improved characteristics including improved bulkiness, particle pick-up, moisture absorbency, reduced drying time, and an advantageous aesthetic appearance.

BACKGROUND

Pile fabrics are manufactured for several different end uses, including as towels, terry fabrics, cleaning products, carpets and the like. Pile fabrics are considered advantageous in view of their light weight, softness, ability to pick up particles and absorb moisture. In cases where pile fabrics are used to manufacture towels or terry fabrics, there is a growing need for improving moisture absorption and reducing drying time while enabling manufacture of fabrics with a pleasant aesthetic look and feel.

FIG. 1A illustrates a pile fabric 100 of the towel type, having a surface region 102. Pile fabrics of the kind illustrated in FIG. 1A typically comprise a woven ground fabric comprising a plurality of substantially parallel warp yarns, and a plurality of substantially parallel weft yarns—wherein the plurality of weft yarns intersect the plurality of warp yarns substantially perpendicularly. Additionally, a plurality of pile yarns are woven through the ground fabric in a pile weave—which pile weave forms a plurality of pile loops above and below the woven ground fabric.

FIG. 1B provides a magnified view of surface region 102 of pile fabric 100. Surface region 102 illustrates the woven ground fabric comprising a plurality of warp yarns 104*a* to 104*c*, substantially perpendicular weft yarns 106*a* to 106*c*, and pile yarns woven in a pile weave so as to form pile loops 108*a* to 108*c* raised above the ground fabric. While not illustrated in FIG. 1B, it would be understood that a pile fabric may include pile loops on both sides of the ground fabric.

Pile yarn is generally a low-twist yarn, since pile loops seek provide surface area for absorption of water, and the low-twist improves absorption by imparting wicking properties. Warp and weft yarns within the ground fabric are generally (but not necessarily) hard twisted (i.e. are high-twist) in comparison with the pile yarn.

Manufacture of pile yarns, warp yarns and/or weft yarns may involve doubling or plying of two or more yarns. Generally in the case of pile yarn for manufacture of towel or terry fabrics, doubling involves twisting a first non-water soluble yarn (e.g. a cotton yarn) and a second water soluble yarn (e.g. a yarn made of polyvinyl alcohol (PVA)) together so that the resulting 2-ply yarn has improved strength and can be subjected to higher tension during the weaving process. In certain cases, the first non-water soluble yarn and the second water soluble yarn are twisted together in a direction opposite to the twist direction of the non-water soluble yarn. The water soluble yarn or fibre is thereafter dissolved, leaving behind a woven fabric comprising entirely of non-water soluble yarn.

In manufacturing terry fabrics, properties such as low twist, and increased thickness or bulkiness are considered advantageous. Additionally, manufacturers constantly seek to improve tactile feel and aesthetic characteristics of terry fabrics.

In terms of aesthetic characteristics, pile fabrics present particular complexities, since it is important to have consistent aesthetic characteristics across the dimension of the fabric. While known methods for patterning pile fabrics include printing a pattern on the fabric surface or forming the fabric using a jacquard weave or knit process, there is a need for other improvements in pile manufacturing technologies for achieving advantageous aesthetic and tactile characteristics.

The present invention seeks to provide pile fabrics with improved tactile properties, particle pick-up and moisture absorption and reduced drying time, while presenting aesthetically pleasing characteristics.

SUMMARY

The invention provides a pile fabric comprising: (i) a woven ground fabric comprising a plurality of warp yarns and a plurality of weft yarns intersecting the plurality of warp yarns, (ii) one or more pile yarns woven to form a plurality of pile loops extending from the ground fabric, wherein (a) at least one pile yarn from among the one or more pile yarns is a multi-ply pile yarn comprising a first pile component yarn plied with a second pile component yarn, and (b) a turns-per-loop of the multi-ply pile yarn is less than 1.9 turns-per-loop.

The first pile component yarn may comprise a first non-soluble yarn. The first pile component yarn may additionally comprises a first soluble yarn plied with the first non-soluble yarn, wherein solubility of the first soluble yarn in a specified solvent (such as for example, water, caustic soda (NaOH) or any other solvent) is higher than solubility of the first non-soluble yarn in said solvent.

The second pile component yarn may comprise a second non-soluble yarn. The second pile component yarn may additionally comprise a second soluble yarn plied with the second non-soluble yarn, wherein solubility of the second soluble yarn in a specified solvent (such as for example, water, caustic soda (NaOH) or any other solvent) is higher than solubility of the second non-soluble yarn in said solvent.

The multi-ply pile yarn may comprise a third pile component yarn plied with the first and second pile component yarns. The third pile component yarn may comprise a third non-soluble yarn. The third pile component yarn may additionally comprise a third soluble yarn plied with the third non-soluble yarn, wherein solubility of the third soluble yarn in a specified solvent (such as for example, water, caustic soda (NaOH) or any other solvent) is higher than solubility of the third non-soluble yarn in said solvent.

In an embodiment, the turns-per-loop of the multi-ply pile yarn within the pile fabric is between 0.9 and 1.5 turns-per-loop.

At least one non-soluble yarn within the multi-ply pile yarn may comprise an s-twisted yarn having a count falling between 12s and 40s Ne. At least one water soluble yarn within the multi-ply pile yarn may comprise a yarn having a count falling between 60s and 100s (Ne), wherein solubility of the soluble yarn in a specified solvent (such as for example, water, caustic soda (NaOH) or any other solvent) is higher than solubility of the non-soluble yarn in said solvent.

The first pile component yarn may have a different colour or colour affinity in comparison with the second pile component yarn (which colour affinity may in an embodiment be specific to a particular dye or colour). In an embodiment, the pile fabric may be a towel or terry fabric.

The invention additionally present a method of producing a pile fabric, comprising the steps of (i) plying at least a first pile component yarn with a second pile component yarn to form a pile yarn, (ii) weaving a pile fabric comprising (a) a plurality of ground warp yarns, (b) a plurality of weft yarns intersecting the plurality of warp yarns, and (c) the pile yarn forming a plurality of pile loops extending from the intersection of the ground warp and weft yarns, (iv) wherein a turns-per-loop of the multi-ply pile yarn is less than 1.9 turns-per loop.

In a method embodiment, the first pile component yarn may comprise a first non-soluble yarn. The first pile component yarn may additionally comprise a first-soluble yarn plied with the first non-soluble yarn, wherein solubility of the first soluble yarn in a specified solvent (such as for example, water, caustic soda (NaOH) or any other solvent) is higher than solubility of the first non-soluble yarn in said solvent.

In another embodiment, the second pile component yarn may comprise a second non-soluble yarn. The second pile component yarn may additionally comprise a second water-soluble yarn plied with the second non-water soluble yarn, wherein solubility of the second soluble yarn in a specified solvent (such as for example, water, caustic soda (NaOH) or any other solvent) is higher than solubility of the second non-soluble yarn in said solvent.

The multi-ply pile yarn may in a specific embodiment comprise a third pile component yarn plied with the first and second pile component yarns. The third pile component yarn comprises a third non-soluble yarn. The third pile component yarn may additionally comprise a third soluble yarn plied with the third non-soluble yarn, wherein solubility of the third soluble yarn in a specified solvent (such as for example, water, caustic soda (NaOH) or any other solvent) is higher than solubility of the third non-soluble yarn in said solvent.

In a particular embodiment of the method, the turns-per-loop of the multi-ply pile yarn is between 0.9 and 1.5 turns-per-loop. The first pile component yarn and second pile component yarn may be plied together at a twists-per-inch of between 3 and 4 twists-per-inch. Further, in weaving the pile fabric, pile height of pile loops formed by the multi-ply pile yarn may be between 4 mm and 6 mm.

At least one non-soluble yarn plied into the multi-ply pile yarn may comprise an s-twisted yarn having a count falling between 12s and 40s Ne. At least one soluble yarn plied into the multi-ply pile yarn may comprise a PVA yarn having a count falling between 60s and 100s Ne.

In a method embodiment, the first pile component yarn may be selected to have either a different colour or a different colour affinity in comparison with the second pile component yarn (which colour affinity may in an embodiment be specific to a particular dye or colour).

In a specific method embodiment, the woven pile fabric is a towel or terry fabric.

DETAILED DESCRIPTION

Figure 1A:
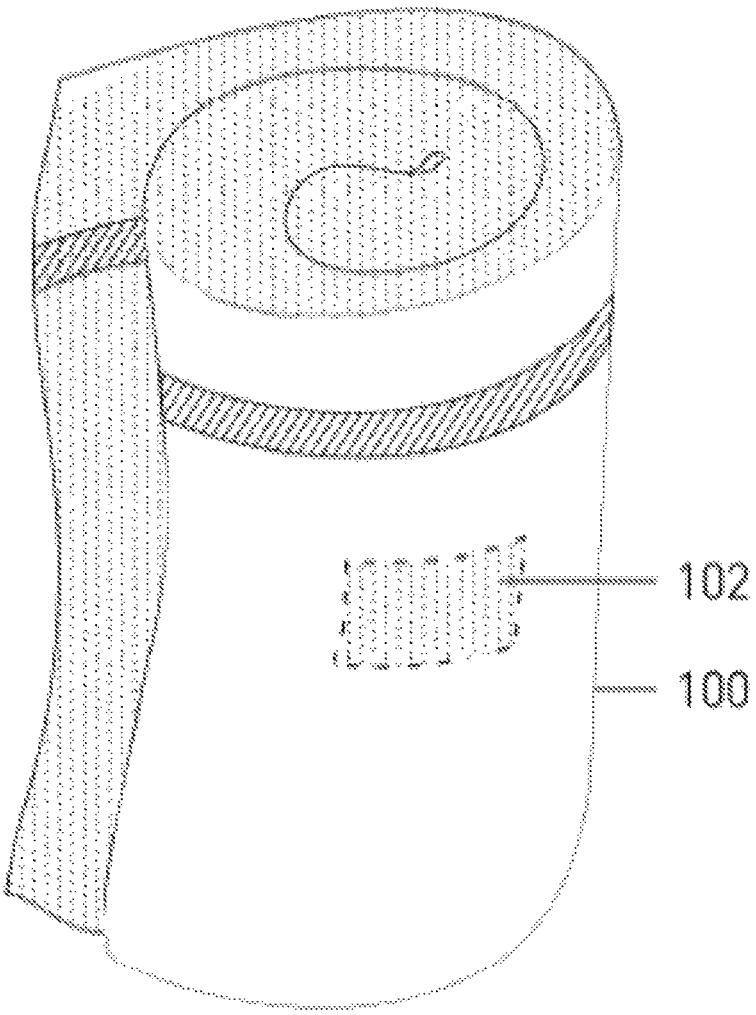
FIG. 1A (PRIOR ART)
FIG. 1A illustrates a pile fabric of the towel type.

The present invention relates generally to pile fabrics, including towels—and more particularly to a pile fabric with improved look and feel, particle pick-up and moisture absorption, and reduced drying time.

Conventionally, pile yarns used in terry or toweling fabrics are coarse and range from 8s to 30s Ne (Number English)—either in a single yarn configuration, or in a doubled configuration. The coarser yarns have a greater number of fibres in the cross section, which improves moisture absorption. However beyond a point, increasing yarn coarseness fails to further increment moisture absorption. Additionally, simply increasing thickness of a pile yarn increases the yarn volume without a commensurate increase in surface area of the pile loops. Without sufficient surface area, the wicking and moisture absorption efficiency as well as drying properties of the pile loops is adversely affected.

The present invention accordingly seeks to maximise the available surface area for a given weight of the product—thereby improving the wicking properties as well as reducing the drying time of the pile fabric.

The invention achieves this by the following steps:

(1a) Plying a first yarn: a first yarn is manufactured by plying (twisting or doubling) at least a first non-soluble yarn with a first soluble yarn resulting in a 2-ply (or multi-ply) first yarn, wherein solubility of the first soluble yarn in a specific solvent is higher than solubility of the first non-soluble yarn in said solvent. In an embodiment, the first non-soluble yarn is a non-water soluble yarn, while the first soluble yarn is a water soluble yarn or filament.

(1b) Plying a second yarn: a second yarn is manufactured by plying (twisting or doubling) at least a second non-soluble yarn with a second soluble yarn resulting in a 2-ply (or multi-ply) second yarn, wherein solubility of the second soluble yarn in a specific solvent is higher than solubility of the second non-soluble yarn in said solvent. In an embodiment, the second non-soluble yarn is a non-water soluble yarn, while the second soluble yarn is a water soluble yarn or filament.

(1c) Plying the 2-ply (or multi-ply) first yarn and 2-ply (or multi-ply) second yarn together: a pile yarn is manufactured by doubling at least the 2-ply (or multi-ply) first yarn together with the 2-ply (or multi-ply) second yarn, at a pre-determined twist ratio, wherein the pre-determined twist ratio is specifically selected to maximise surface area of individual pile loops in the pile fabric that is subsequently woven using the pile yarn.

(1d) Weaving a pile fabric: a pile fabric is woven using the pile yarn and appropriately selected warp and weft yarns to produce a pile fabric of desired size and weight.

(1e) Washing the pile fabric: the pile fabric is exposed to conditions suitable to dissolve the first soluble yarn and the second soluble yarn within the pile fabric. In an embodiment where the first soluble yarn and the second soluble yarn are water soluble yarns, this step comprises exposing the pile fabric to hot water at above 60° C., preferably above 80° C. and yet more preferably between 80° C. and 95° C., to dissolve the soluble fibres, leaving a pile fabric wherein the pile yarn comprises a loosely bound 2-ply (or multi-ply) yarn comprising at least the first non-soluble yarn and the second non-soluble yarn.

For the purposes of the present invention, it will be understood that when discussing a multi-ply pile yarn comprising a soluble yarn and a non-soluble yarn, such solubility and non-solubility is with respect to a specific solvent. Additionally, the solubility and non-solubility of such yarns need not be absolute and may be relative to each other. In the broadest embodiments contemplated by the present invention, in a multi-ply yarn comprising a soluble yarn plied with a non-soluble yarn, solubility of the soluble yarn in a specified solvent (such as for example, water, caustic soda (NaOH) or any other solvent) is higher than solubility of the non-soluble yarn in the same solvent.

In connection with method steps (1a) to (1e) described above, it has been discovered that in addition to ensuring low-twist and suitable thickness for the pile yarn, significant advantages arise from ensuring that the turns-per-loop of the pile yarn falls within a specified range. More specifically, it has been found that by ensuring that the turns-per-loop of the pile yarn in the woven pile fabric is between 0.9 to 1.9, the first non-soluble yarn and the second non-soluble yarn within each pile loop assume a "teased" or "clustered" configuration after the woven pile fabric is exposed to the appropriate solvent (such as hot water or NaOH) and the soluble yarns are dissolved. This "teased" or "clustered" fabric geometry comprises a specific pile yarn configuration wherein in each pile loop, the first non-soluble yarn forms a first sub-loop and the second non-soluble yarn forms a second sub-loop. The first sub-loop and second sub-loop are loosely twisted or minimally intertwined together as a result of the selected turns-per-loop, thereby ensuring interspaces between the first sub-loop and second sub-loop of each pile loop with a consequent increase in total available surface area of each pile loop.

Figure 2:
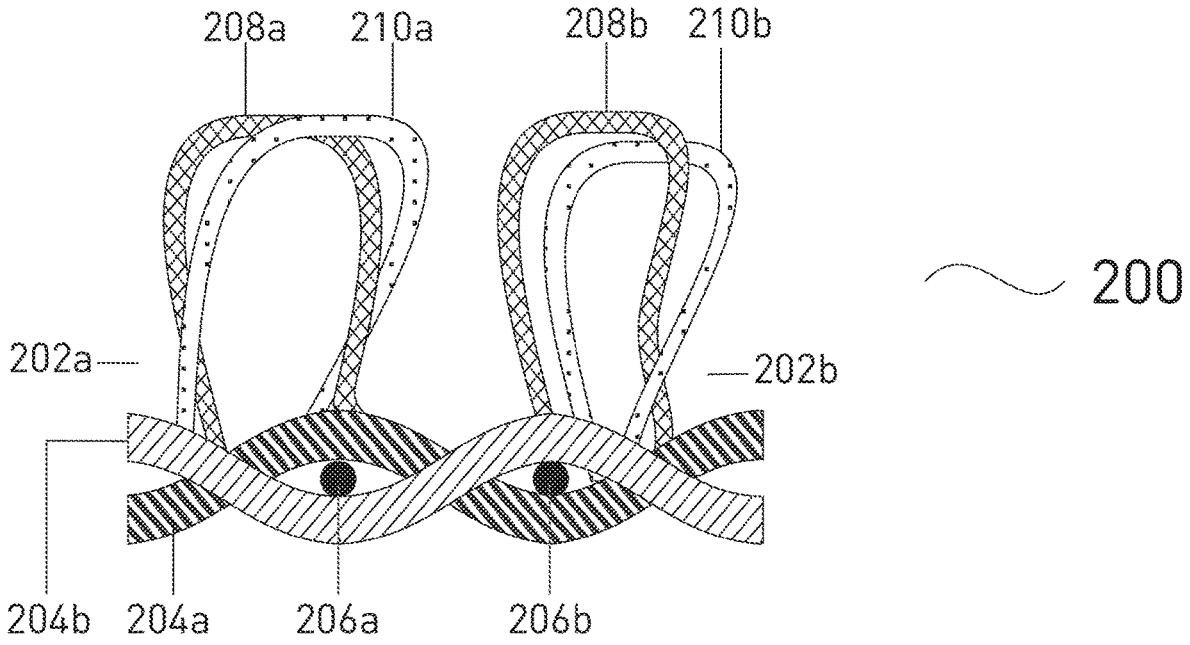
FIG. 2 illustrates a magnified section of a pile fabric manufactured in accordance with steps (1a) through (1e) of the disclosure.

FIG. 2 illustrates a magnified section of a pile fabric 200 manufactured in accordance with the method described in connection with steps (1a) to (1e) above. Pile fabric 200 comprises warp yarns 204*a* and 204*b*, weft yarns 206*a* and 206*b*, and a 2-ply pile yarn comprising a first non-soluble yarn and a second non-soluble yarn (for example first and second non-water soluble yarns). In a first pile loop 202*a*, the first non-soluble yarn forms a first sub-loop 208*a* and the second non-soluble yarn forms a second sub-loop 210*a*. Likewise in a second pile loop 202*b*, the first non-soluble yarn forms a first sub-loop 208*b* and the second non-soluble yarn forms a second sub-loop 210*b*. In the loosely twisted or loosely intertwined configuration achieved by keeping the turns-per-loop of the pile yarn between the prescribed limit of 0.9 and 1.9, it can be seen that the first and second sub-loops of each pile loop have inter spaces between them, thereby increasing the ratio of surface area to yarn (or fibre or filament) weight within each pile loop—with corresponding improvements in wicking, bulkiness (voluminousness), and moisture absorption, as well as a reduction of drying time.

It would be understood that the present invention is not limited to embodiments where the pile yarn is a 2-ply yarn manufactured using a first 2-ply yarn and a second 2-ply yarn. The invention can accommodate a pile yarn manufactured by plying together any reasonable number of 2-ply (or multi-ply) yarns that may be contemplated by the skilled person while maintaining the turns-per-loop within the predetermined ranges that are necessary for achieving the objectives of the invention.

The following exemplary embodiment of the invention involves manufacture of a pile yarn by plying together three 2-ply yarns. In the exemplary embodiment, the invention implements the following steps:

(2a) Plying a first yarn: a first yarn is manufactured by plying (twisting or doubling) a first non-soluble yarn with a first soluble yarn resulting in a 2-ply first yarn, wherein solubility of the first soluble yarn in a specific solvent is higher than solubility of the first non-soluble yarn in said solvent. In an embodiment, the first non-soluble yarn is a non-water soluble yarn, while the first soluble yarn is a water soluble yarn or filament.

(2b) Plying a second yarn: a second yarn is manufactured by plying (twisting or doubling) a second non-soluble yarn with a second soluble yarn resulting in a 2-ply second yarn, wherein solubility of the second soluble yarn in a specific solvent is higher than solubility of the second non-soluble yarn in said solvent. In an embodiment, the second non-soluble yarn is a non-water soluble yarn, while the second soluble yarn is a water soluble yarn or filament.

(2c) Plying a third yarn: a third yarn is manufactured by plying (twisting or doubling) a third non-soluble yarn with a third soluble yarn resulting in a 2-ply third yarn, wherein solubility of the third soluble yarn in a specific solvent is higher than solubility of the third non-soluble yarn in said solvent. In an embodiment, the third non-soluble yarn is a non-water soluble yarn, while the third soluble yarn is a water soluble yarn or filament.

(2d) Plying the 2-ply first yarn, 2-ply second yarn and 2-ply third yarn together: a pile yarn is manufactured by plying (twisting or doubling) the 2-ply first yarn together with the 2-ply second yarn and the 2-ply third yarn, at a pre-determined twist ratio, wherein the predetermined twist ratio is specifically selected to maximise surface area of individual pile loops in the pile fabric that is subsequently woven using the pile yarn.

(2e) Weaving a pile fabric: a pile fabric is woven using the pile yarn and appropriately selected warp and weft yarns to produce a pile fabric of desired size and weight.

(2f) Washing the pile fabric: the pile fabric is exposed to conditions suitable to dissolve the first soluble yarn, the second soluble yarn and the third soluble yarn within the pile fabric. In an embodiment where the first soluble yarn, second soluble yarn and third soluble yarn are water soluble yarns, this step comprises exposing the pile fabric to hot water at above 60° C., preferably above 80° C. and yet more preferably at between 80° C. and 95° C., to dissolve the soluble fibres, leaving a pile fabric wherein the pile yarn comprises a loosely bound 3-ply pile yarn comprising the first non-soluble yarn, the second non-soluble yarn and the third non-soluble yarn.

Figure 3:
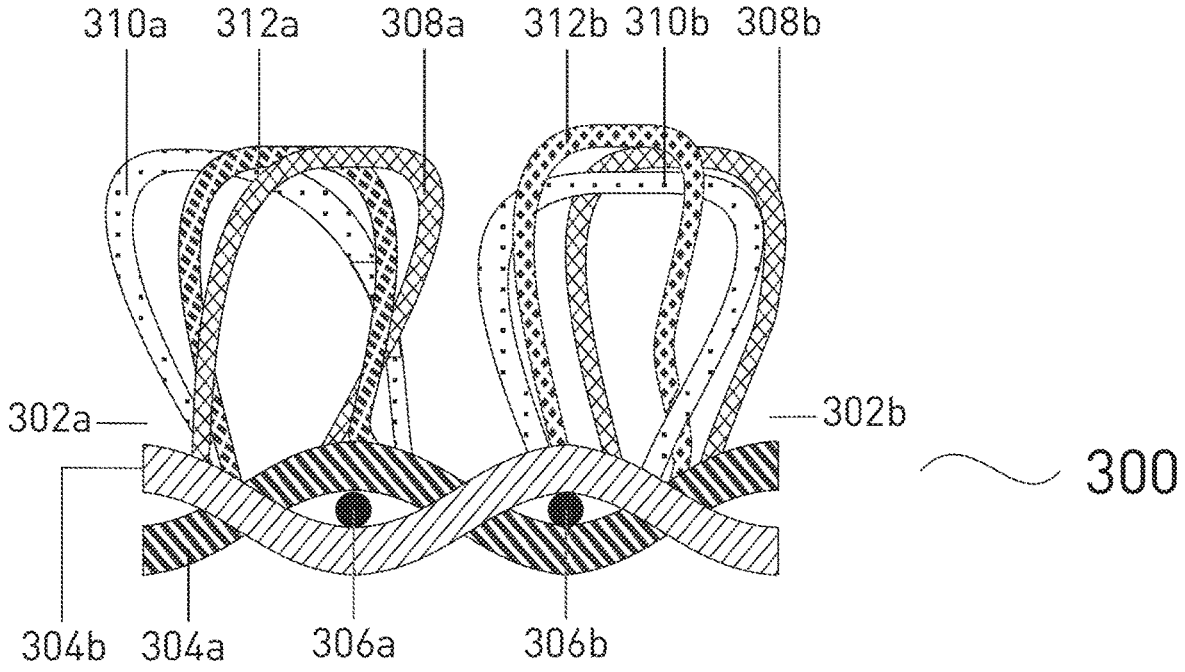
FIG. 3 illustrates a magnified section of a pile fabric manufactured in accordance with steps (2a) through (2f) of the disclosure.

FIG. 3 illustrates a magnified section of a pile fabric 300 manufactured in accordance with the teachings of steps (2a) to (2f) above. Pile fabric 300 comprises warp yarns 304*a* and 304*b*, weft yarns 306*a* and 306*b*, and a pile yarn comprising a first non-soluble yarn, a second non-soluble yarn and a third non-soluble yarn. In a first pile loop 302*a*, the first non-soluble yarn forms a first sub-loop 308*a*, the second non-soluble yarn forms a second sub-loop 310*a* and the third non-soluble yarn forms a third sub-loop 312*a*. Likewise in a second pile loop 302*b*, the first non-soluble yarn forms a first sub-loop 308*b*, the second non-soluble yarn forms a second sub-loop 310*b* and the third non-soluble yarn forms a third sub-loop 312*b*. In the loosely intertwined configuration achieved by keeping the turns-per-loop of the pile yarn between the prescribed range of 0.9 to 1.9, it can be seen that the first, second and third sub-loops of each pile loop have inter spaces between them, thereby increasing the exposed surface area within each pile loop that is available to interact with water or liquid (for absorption purposes), or to interact with particles (for particle pick-up purposes), —with corresponding improvements in wicking, bulkiness (voluminousness), moisture absorption and particle pick-up, and a reduction in drying time of the pile fabric.

Figure 4:
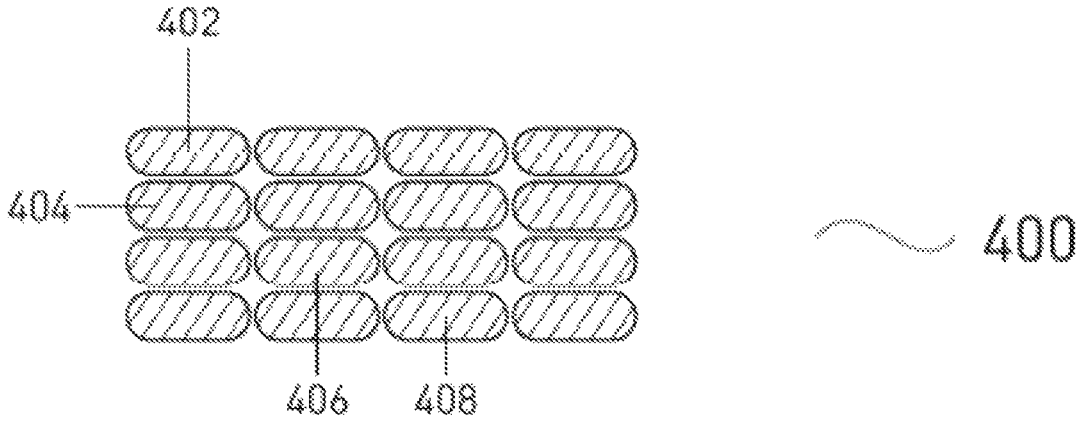
FIG. 4 (PRIOR ART)
FIG. 4 illustrates a magnified top view of a conventional pile fabric.
Figure 5:
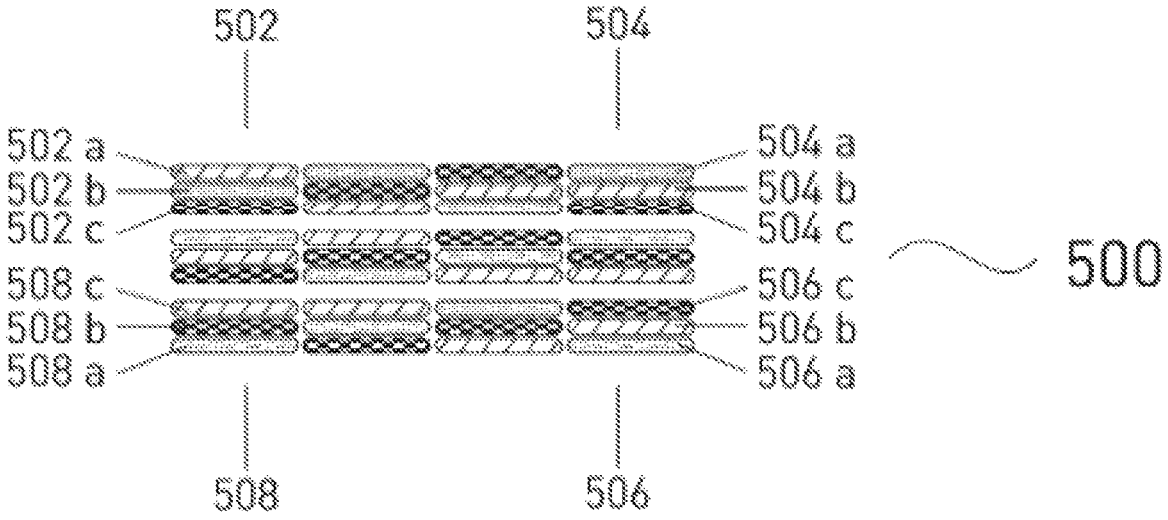
FIG. 5 illustrates a magnified top view of a pile fabric prepared in accordance with steps (2a) through (2f) of the disclosure.

FIGS. 4 and 5 further illustrate advantages offered by pile fabric prepared in accordance with the present invention in comparison with pile fabric prepared in accordance with the methods known in the prior art.

FIG. 4 illustrates a magnified top view of a conventional pile fabric 400, wherein the pile yarn is a single ply yarn, or is a multi-ply yarn having turns-per-loop outside of the ranges prescribed above. In comparison FIG. 5 illustrates a magnified top view of a pile fabric 500 prepared in accordance with steps (2a) to (2f) described herein above—resulting in a pile yarn having three loosely twisted or intertwined sub-loops per pile loop.

As can be observed in FIG. 4 each pile loop (402, 404, 406, 408) of pile fabric 400 presents a substantially unbroken or continuous surface area, with inter spaces only observable between each pile loop. In contrast, as shown in FIG. 5, each pile loop (502, 504, 506, 508) comprises three sub-loops (502*a*, 502*b*, 502*c*;504*a*, 504*b*, 504*c*; 506*a*, 506*b*, 506*c*;508*a*, 508*b*, 508*c*) with inter spaces observable not just between each pile loop, but also between sub-loops of each pile loop. Additionally, the cumulative surface area presented by each group of sub-loops within a pile loop in FIG. 5 is significantly greater than the surface area presented by each loop in FIG. 4. It would be understood that the increase in cumulative surface area and inter spaces within each loop significantly increases not only wicking properties and moisture absorption, and also reduces drying time of the pile fabric.

Figure 1B:
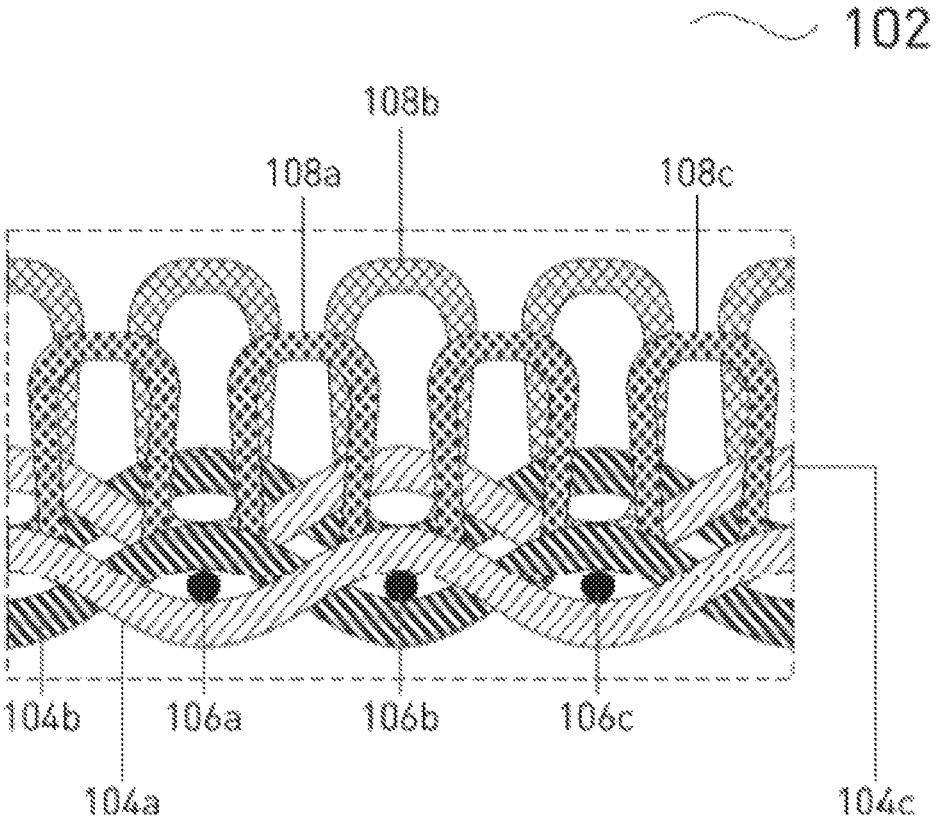
FIG. 1B (PRIOR ART)
FIG. 1B illustrates a magnified view of a surface region of the pile fabric of FIG. 1A.

In a first working example, a surface area comparison was carried out between (i) a first pile fabric manufactured in accordance with steps (2a) to (2f) described above and having a pile yarn comprising three 30s (Ne) count cotton yarns (i.e. a cumulative yarn count of 10s (Ne)) plied together in the 3 sub-loop type fabric geometry illustrated in FIG. 3 and FIG. 5 and (ii) a second conventionally manufactured pile fabric having a pile yarn comprising a single 10s (Ne) count cotton yarn in a unified loop fabric geometry of the type illustrated in FIG. 1B and FIG. 4—where both pile fabrics have an identical loop length (L1).

It is known that yarn diameter (D) of a yarn may be derived in accordance with equation (1) below:

$$D = \frac{1}{28 \times \sqrt[2]{\text{Yarn count in Ne}}} \qquad \text{Equation (1)}$$

Applying equation (1), it can be determined that:

diameter D1 of each cotton yarn having count 30s (Ne) within the first pile fabric having the clustered configuration of the present invention is 0.0065 inches, and diameter D2 of a cotton yarn having count 10s (Ne) within the second pile fabric having a conventional non-clustered configuration is 0.0113 inches.

Surface area (area) of a pile loop may be determined in accordance with equation (2) below:

$$\text{SurfaceArea} = \pi \times L \times D \qquad \text{Equation (2)}$$

wherein L represents loop length and D represents yarn diameter.

The cumulative surface area of a pile loop having one or more than one sub-loops may accordingly be determined in accordance with equation (3) below:

$$\text{cumulative surface area of pile loop} = N \times \pi \times L \times D \qquad \text{Equation (3)}$$

wherein L represents loop length, D represents yarn diameter, and N represents the number of sub-loops within the pile loop.

Applying equation (3) and the computed values for D1 and D2 for the first and second pile fabrics under comparison, it can be determined that:

For a pile loop (comprising 3 cotton yarns each of count 30s (Ne) and a loop length L1) within the first pile fabric having the clustered configuration of the present invention (i.e. number of sub-loops N=3, loop length=L1 and yarn diameter D1), cumulative surface area (SurfaceArea1) of the pile loop in accordance would be:

$$\text{SurfaceArea1} = 3 \times \pi \times L1 \times D1$$

For a pile loop (comprising a cotton yarns of count 10s (Ne) and a loop length L1) within the second pile fabric having a conventional non-clustered configuration (i.e. number of sub-loops N=1, loop length=L1 and yarn diameter D2) cumulative surface area (SurfaceArea2) of the pile loop in accordance would be:

$$\text{SurfaceArea2} = \pi \times L1 \times D2$$

The percentage increase (SurfaceIncrease1) in surface area exhibited by a pile loop (within the first pile fabric) having SurfaceArea1 in comparison with a pile loop (within the second pile fabric) having SurfaceArea2 would be:

$$SurfaceIncrease1 = \left(\left(\frac{SurfaceArea1}{SurfaceArea2} \times 100\right) - 100\right)\%$$

i.e.

$$SurfaceIncrease1 = \left(\left(\frac{3 \times \pi \times L1 \times D1}{\pi \times L1 \times D2} \times 100\right) - 100\right)\%$$

i.e.

$$SurfaceIncrease1 = \left(\left(\frac{3 \times D1}{D2} \times 100\right) - 100\right)\%$$

i.e.

$$SurfaceIncrease1 = \left(\left(\frac{3 \times 0.0065}{0.0113} \times 100\right) - 100\right)\%$$

i.e.

$$SurfaceIncrease1 = 72\%$$

Accordingly, in the first working example, the first pile fabric manufactured in a 3 sub-loop configuration in accordance with steps (2a) to (2f) described above, exhibits a 72% increase in surface area over the second pile fabric manufactured in accordance with conventional techniques, despite the pile yarn in both fabrics having substantially the same cumulative pile yarn count (and pile yarn weight or pile loop weight).

In a second working example, a surface area comparison was carried out between (i) a third pile fabric manufactured in accordance with steps (1a) to (1e) described above, and having a pile yarn comprising two cotton yarns having a count of 24s (Ne) each (i.e. a cumulative yarn count of 12s (Ne)) plied together in the 2 sub-loop type fabric geometry of the type illustrated in FIG. 2 and (ii) a fourth conventionally manufactured pile fabric having a pile yarn comprising a single cotton yarn having a count of 12s (Ne) in a conventional unified loop fabric geometry of the type illustrated in FIG. 1B and FIG. 4—where both pile fabrics have an identical loop length (L2).

Applying equation (1), it can be determined that:

diameter D3 of each cotton yarn having count 24s (Ne) within the third pile fabric having the clustered configuration of the present invention is 0.0072 inches, and diameter D4 of a cotton yarn having count 12s (Ne) within the fourth pile fabric having a conventional non-clustered configuration is 0.0103 inches.

Applying equation (3) and the computed values for D3 and D4 for the third and fourth pile fabrics under comparison, it can be determined that:

For a pile loop (comprising 2 cotton yarns each of count 24s (Ne) and a loop length L2) within the third pile fabric having the clustered configuration of the present invention (i.e. number of sub-loops N=2, loop length=L2 and yarn diameter D3) cumulative surface area (SurfaceArea3) of the pile loop in accordance would be:

$$\text{SurfaceArea3}=3\times\pi\times L2\times D3$$

For a pile loop (comprising a cotton yarns of count 12s (Ne) and a loop length L2) within the fourth pile fabric having a conventional non-clustered configuration (i.e. number of sub-loops N=1, loop length=L2 and yarn diameter D4) cumulative surface area (SurfaceArea4) of the pile loop in accordance would be:

$$\text{SurfaceArea4}=\pi\times L2\times D4$$

The percentage increase (SurfaceIncrease2) in surface area exhibited by a pile loop (within the third pile fabric) having SurfaceArea3 in comparison with a pile loop (within the fourth pile fabric) having SurfaceArea4 would be:

$$SurfaceIncrease2=\left(\left(\frac{SurfaceArea3}{SurfaceArea4}\times 100\right)-100\right)\%$$

i.e.

$$SurfaceIncrease2=\left(\left(\frac{2\times\pi\times L2\times D3}{\pi\times L2\times D4}\times 100\right)-100\right)\%$$

i.e.

$$SurfaceIncrease2=\left(\left(\frac{2\times D3}{D4}\times 100\right)-100\right)\%$$

i.e.

$$SurfaceIncrease2=\left(\left(\frac{2\times 0.0072}{0.0103}\times 100\right)-100\right)\%$$

i.e.

$$SurfaceIncrease2=39.8\%$$

Accordingly, in the second working example, the third pile fabric manufactured in a 2 sub-loop configuration in accordance with steps (1a) to (1e) described above, exhibits a 39.8% increase in surface area over the fourth pile fabric manufactured in accordance with conventional techniques, despite the pile yarn in both fabrics having substantially the same cumulative pile yarn count (and pile yarn weight or pile loop weight).

The improvements in surface area of pile loops for the same pile yarn count and yarn weight results in substantial improvements in moisture absorption, particle pick-up and overall look and feel of the pile fabrics manufactured in accordance with the present invention.

As established above, the advantages of the present invention can be achieved by ensuring in the fabric weaving process that turns-per-loop of the multi-ply pile yarn in the woven pile fabric is between 0.9 and 1.9. In a preferred embodiment the turns-per-loop of the multi-ply pile yarn in the woven fabric is between 0.9 and 1.5. It has been discovered that as pile height of the woven pile fabric increases, the turns-per-loop within the multi-ply pile yarn can move towards the higher end of the prescribed range while retaining the advantageous effects of the invention. Likewise, as pile height of the woven pile fabric decreases, the turns-per-loop within the multi-ply pile yarn has to move towards the lower end of the prescribed range to ensure that sub-loops within each pile loop remain loosely twisted or intertwined (and as if the pile sub-loops are almost separate) and thus resulting in increased inter spaces therebetween.

The turns-per-loop of the pile yarn in a woven pile fabric can be modulated in a number of ways, including by selection of appropriate twists ratio for the multi-ply pile yarn, and/or selection of an appropriate pile height for the woven pile fabric.

The below table provides examples of measured parameters corresponding to multi-ply pile yarn within a woven pile fabric prepared in accordance with the teachings of the present invention, and which were found to demonstrate the desired properties of increased pile loop surface area, improved moisture absorption, particle pick-up and wicking, and reduced drying times. It will be understood that the use of the below examples (and any others) anywhere in the specification is only illustrative and is not intended to limit the scope of the invention.

| | Example A | Example B | Example C | Example D | Example E |
|---|---|---|---|---|---|
| TPL ratio of the woven pile fabric (Turns/loop) | 0.9 | 1.0 | 1.5 | 1.9 | 1.9 |
| Direction of Twist of the plied pile yarn | S or Z | S or Z | S or Z | S or Z | S or Z |
| Pile Height of the woven pile fabric (mm) | 4.0 | 6.0 | 6.2 | 6.0 | 6.0 |
| Plying TPI of the pile yarn (number of twists/inch) | 3.0 | 2.1 | 3.0 | 4.0 | 4.0 |

The above examples are based on working examples conducted using a 2-ply pile yarn within a pile fabric manufactured in accordance with steps (1a) to (1e) described above, wherein the non-soluble yarns are cotton yarns, and the soluble yarns are polyvinyl alcohol PVA yarns or fibres. The working examples were carried out using conventional yarn plying techniques and pile fabric weaving techniques that would be apparent to the skilled person.

In a preferred embodiment of the invention, the twists-per-inch implemented while plying the multi-ply pile yarn has been found to be between 3 and 4 twists-per-inch, while the pile height selected while weaving the pile fabric (or that was measurable in the woven pile fabric) has been found to be between 4 mm and 6 mm. In an embodiment at least one (and preferably all) of the non-soluble yarns within the multi-ply pile yarn falls within a count range of between 12s and 40s Ne and more preferably within a count range of between 16s and 40s Ne.

Non-soluble yarns for manufacturing the multi-ply pile yarn in accordance with embodiments of the present invention may comprise any one or more natural fibres such as cotton, wool, silk, jute, flax, bamboo or ramie, or one or more regenerated/synthetic fibres such as lyocell, viscose, modal, soya, polyester, nylon, acrylic, rayon, charcoal, linen, corn, milk fibre, PLA (poly lactic acid) fibre, etc. In a preferred embodiment of the invention, the non-soluble yarns used to manufacture a pile yarn are yarns that are non-soluble in water or caustic soda (NaOH).

Soluble yarns for manufacturing each plied yarn for subsequent spinning of the multi-ply pile yarn may include any of PVA, wool or a yarn product that is sold under the trade name "solucell". In embodiments of the pile yarn or pile fabric, where the non-soluble yarn is a non-water soluble yarn and the intended solvent is water, PVA may be selected as the corresponding water-soluble yarn. In embodiments where the non-soluble yarn is a non-caustic soda (NaOH) soluble yarn and the intended solvent is caustic soda (NaOH), wool or solucell may be selected as the corresponding soluble yarn. In an embodiment, one or more of each soluble yarns is in a count range between 60s and 100s Ne.

It would be understood that plying of each non-soluble yarn with a corresponding soluble yarn in accordance with the embodiments described above may use any conventional plying techniques known in the art. Likewise the plying of 2 or more multi-ply yarns to manufacture a single multi-ply pile yarn, subsequent weaving of a pile fabric and removal of the soluble yarn from such pile fabric may use any one or more conventional techniques known in the art.

The teachings of the present invention result in a pile fabric wherein each pile loop comprises a plurality of loosely twisted or intertwined sub-loops, which loosely twisted of intertwined sub-loops may in an embodiment comprise between 2 and 5 sub-loops per pile loop. Additionally, in view of the loosely twisted or intertwined configuration of the sub-loops within each pile loop, said sub-loops exhibit a clustered or petal-like configuration within each pile loop.

In an embodiment of the invention at least a first non-soluble yarn within the pile yarn has a first colour affinity (which first colour affinity may be specific to a particular dye or colour), while a second non-soluble yarn within the pile yarn has a second colour affinity (which second colour affinity may be specific to a specific dye or colour and which may be different from the first colour affinity)—such that in a subsequent dyeing step, the first non-soluble yarn acquires a different colouring from the second non-soluble yarn. Accordingly, subsequent to the steps of weaving of the pile fabric in accordance with the teachings of the present invention, dissolving or washing out of soluble yarns from the pile fabric and dyeing, the resulting pile fabric comprises a plurality of pile loops, wherein each pile loop includes a plurality of loosely twisted or intertwined sub-loops of which at least a first sub-loop and a second sub-loop within each pile loop have different colours (as a result of the different colour affinities of the first and second non-soluble yarns respectively).

In an alternative embodiment of the invention, at least a first non-soluble yarn having a first yarn colour is plied together with a first soluble yarn to form a first 2-ply yarn, and at least a second non-soluble yarn having a second yarn colour (which in an embodiment is different from the first yarn colour) is plied together with a second soluble yarn to form a second 2-ply yarn, whereinafter a multi-ply pile yarn is manufactured using at least the first 2-ply yarn and the second 2-ply yarn. In this embodiment, subsequent to weaving of the pile fabric in accordance with the teachings of the present invention, and subsequent to dissolving or washing out of soluble yarns, the resulting pile fabric includes a plurality of pile loops wherein each pile loop comprises a plurality of loosely twisted or intertwined sub-loops, and at least a first sub-loop and a second sub-loop within each pile loop have different colours (i.e. corresponding to the first yarn colour and the second yarn colour).

Having at least two different yarn colours within each pile loop, in combination with the clustered or petal-like appearance exhibited by sub-loops within each pile loop results in a striking plurality of tones, and consequent melange, heather-like, mottled or tone-on-tone appearance of the pile fabric. In overall appearance, the resulting product has been found to present pleasing aesthetic colour combinations, shades, tints, tones and hue characteristics.

Accordingly, manufacture of pile fabrics, including terry fabrics or towel fabrics in accordance with the teachings of the present invention results in the following advantageous features:

Fluffy, bulky appearance
Improved absorption of moisture
Reduced drying time
Improved tactile feel
Pleasing aesthetic colour characteristics It would be understood that the examples and embodiment discussed anywhere in the present specification are illustrative only. Those skilled in the art would immediately appreciate that various modifications in form and detail may be made without departing from or offending the spirit and scope of the invention as defined by the appended claims.

The invention claimed is:

1. A woven pile fabric comprising:

a woven ground fabric comprising a plurality of ground warp yarns and a plurality of weft yarns intersecting the plurality of warp yarns;

two or more multi-ply pile yarns woven to form a plurality of pile loops extending from the ground fabric, wherein within each pile loop a first pile component yarn forms a first sub-loop and a second pile component yarn forms a second sub-loop such that multiple sub-loops are formed within one pile loop formation after weaving; and turns-per-loop among the sub-loops within each of the pile loops is between 0.9 and 1.9 based on a pile height of the pile loops and a twist-per-inch of the multi-ply pile yarns, wherein the pile height of each pile loop formed by the multi-ply yarns is between 4 mm and 6 mm;

wherein the twist-per-inch among the first and second components of the multi-ply pile yarns is between 3 and 4; and wherein the first sub-loop and the second sub-loop form a cluster of loops within each pile loop formation with interspaces formed between the first and second sub-loops.

2. The woven pile fabric as claimed in claim 1, wherein the two or more multi-ply pile yarns comprises a third pile component yarn plied with the first and second pile component yarns.

3. The woven pile fabric as claimed in claim 2, wherein the third pile component yarn forms a third sub-loop in each pile loop.

4. The woven pile fabric as claimed in claim 1, wherein the turns-per-loop among the sub-loops within each of the pile loops is between 0.9 and 1.5.

5. The woven pile fabric as claimed in claim 1, wherein the first and second pile yarn components are s-twisted yarns having a count falling between 12s and 40s Ne.

6. The woven pile fabric as claimed in claim 1, wherein the first pile component yarn has a different color or color affinity from the second pile component yarn.

7. The woven pile fabric as claimed in claim 1, wherein said woven pile fabric is a towel or terry fabric.

8. The woven pile fabric as claimed in claim 1 wherein the interspaces formed between the first and second sub-loops result in an increased cumulative surface area of the pile yarn in respect to the weight of the pile yarn compared to a pile yarn formed without sub-loops.

* * * * *